United States Patent [19]

Michaud et al.

[11] 4,352,656

[45] Oct. 5, 1982

[54] GAS APPLIANCE CONTROL DEVICE

[75] Inventors: Roger P. Michaud, Lewiston, Me.; Douglas B. Campbell, deceased, late of Gilford, N.H., by Diane Campbell, administratrix

[73] Assignee: American Stabilis, Inc., Lewiston, Me.

[21] Appl. No.: 77,628

[22] Filed: Sep. 21, 1979

[51] Int. Cl.[3] ..... F23H 5/00; F23N 5/00; F23Q 9/08

[52] U.S. Cl. ..... 431/72; 431/74; 431/46

[58] Field of Search ..... 431/72, 73, 74, 78, 431/79, 80, 24, 25, 26, 46, 67, 71, 70

[56] References Cited

U.S. PATENT DOCUMENTS

| | | | |
|---|---|---|---|
| 3,223,138 | 12/1965 | Brown | 158/28 |
| 3,582,249 | 6/1971 | Hodgson | 431/70 |
| 3,895,241 | 7/1975 | Cooper | 307/311 |
| 4,025,283 | 5/1977 | Ray | 431/45 |
| 4,082,493 | 4/1978 | Dahlgren | 431/25 |
| 4,137,428 | 1/1979 | Federico et al. | 179/1 SW |

*Primary Examiner*—Samuel Scott

*Assistant Examiner*—Wesley S. Ratliff, Jr.

*Attorney, Agent, or Firm*—Finnegan, Henderson, Farabow, Garrett & Dunner

[57] ABSTRACT

An electrical control circuit is disclosed for controlling the operation of a pilotless gas system including an igniter and a gas supply valve, wherein the gas supply valve is initially opened a predetermined time after the igniter is activated, and the igniter is subsequently deactivated a predetermined time after the gas supply valve is opened. Specifically, a control first signal is produced to activate the appliance, which control first signal is delivered to a first logic circuit for activating the igniter, and to a first delay circuit which produces a second signal delayed from the first signal by a first predetermined time period. The second signal is delivered to a gas supply valve control circuit to open the supply valve, whereupon a detector produces a third signal in response to opening of the valve. A second delay circuit produces a fourth signal delayed from the third signal by a second predetermined time period, the fourth signal being applied to the first logic circuit for deactivating the igniter a predetermined time period after the opening of the gas supply valve.

8 Claims, 2 Drawing Figures

GAS APPLIANCE CONTROL DEVICE

BACKGROUND OF THE INVENTION

The present invention relates to an electrical control circuit for controlling the operation of a pilotless gas system. The invention finds particular utility in use with a regulated sealed combustion heating system, but can also be used in a wide variety of gas systems and appliances which require safety controls.

It is important for reasons of safety that gas appliances be equipped with a flame detection and control circuit which will assure shut off of gas when no flame is present. The control must also allow for a period of ignition when the gas is on even though there is no flame. When the gas has not been ignited, the system must operate to quickly close the gas valve.

There are a number of types of gas appliances, including heating and air conditioning systems, stoves, dryers, etc., for which such a flame detection and proof device is required. For many years, gas appliances have operated with a pilot light system which ignites the main gas jet when the appliance is turned on. However, in recent years it has been recognized that such systems are not fuel or energy efficient. Consequently, other systems have been introduced to replace the pilot light type of system.

BRIEF DESCRIPTION OF THE PRIOR ART

Co-pending patent application Ser. No. 029,572, filed on Apr. 12, 1979 by the same applicants as the present invention, discloses a flame detection and proof control device which provides safe control of gas systems and appliances and which may be used in conjunction with the gas appliance control device disclosed herein. Various other types of control systems for gas burning apparatus are well known in the art, as evidenced by the U.S. Pat. Nos. to Cade, 3,840,322, to Matthews, 3,918,881, to Kaduki et al, 4,073,611, to Dahlgren, 4,082,493, and to Cade 4,133,419. While the prior devices normally operate quite satisfactorily and are more energy efficient than pilot light type systems, they do possess the inherent drawback of not being suitable for operating with a regulated sealed combustion system.

SUMMARY OF THE INVENTION

Accordingly, it is a primary object of the present invention to provide an electrical control circuit for controlling the operation of a pilotless gas system including an igniter and a gas supply valve. The control circuit includes means for producing an appliance-activating control first signal which is applied to a first logic circuit to activate the igniter. A first delay circuit produces a second signal delayed from the first signal by a first predetermined delay time period, the second signal being applied to a gas supply valve control circuit for opening the gas supply valve after the first delay time period. A detector produces a third signal when the gas supply valve is in the open position, and a second delay circuit produces a fourth signal delayed from the third signal by a second predetermined delay time period. The fourth signal is applied to the first logic circuit to deactivate the igniter a predetermined delay time period after opening of the gas supply valve. The igniter is therefore activated for the first predetermined time period prior to opening of the gas supply valve, and the igniter is deactivated after the second predetermined time period following opening of the gas supply valve.

According to a more specific object of the invention, the control first signal producing circuit includes a plurality of voltage sources and a second logic circuit operable in response to power from at least one of the voltage sources.

It is a further object of the present invention to provide a control circuit wherein the second logic circuit includes an OR gate having a pair of inputs and an output. One of the voltage sources includes a thermostatically controlled optoisolator circuit connected with one input of the OR gate, and another of the voltage sources comprises a logic power voltage source and a low-limit switch connecting the logic power voltage source with the other input of the OR gate. The control first signal thus appears at the output of the OR gate.

According to a further object of the invention, the gas supply valve control circuit includes a high-limit switch and a flame monitor connected in series with the high limit switch. The opening of one of the high-limit switch and flame monitor automatically closes the gas supply valve to shut off the gas supply.

The accompanying drawings, which are incorporated in and constitute a part of the specification, illustrate embodiments of the invention and, together with the description, serve to explain the principles of the invention.

BRIEF DESCRIPTION OF THE DRAWINGS

Other objects and advantages of the invention will become apparent from a study of the following specification when viewed in the light of the accompanying drawings, in which.

DESCRIPTION OF PREFERRED EMBODIMENT

Figure 1:
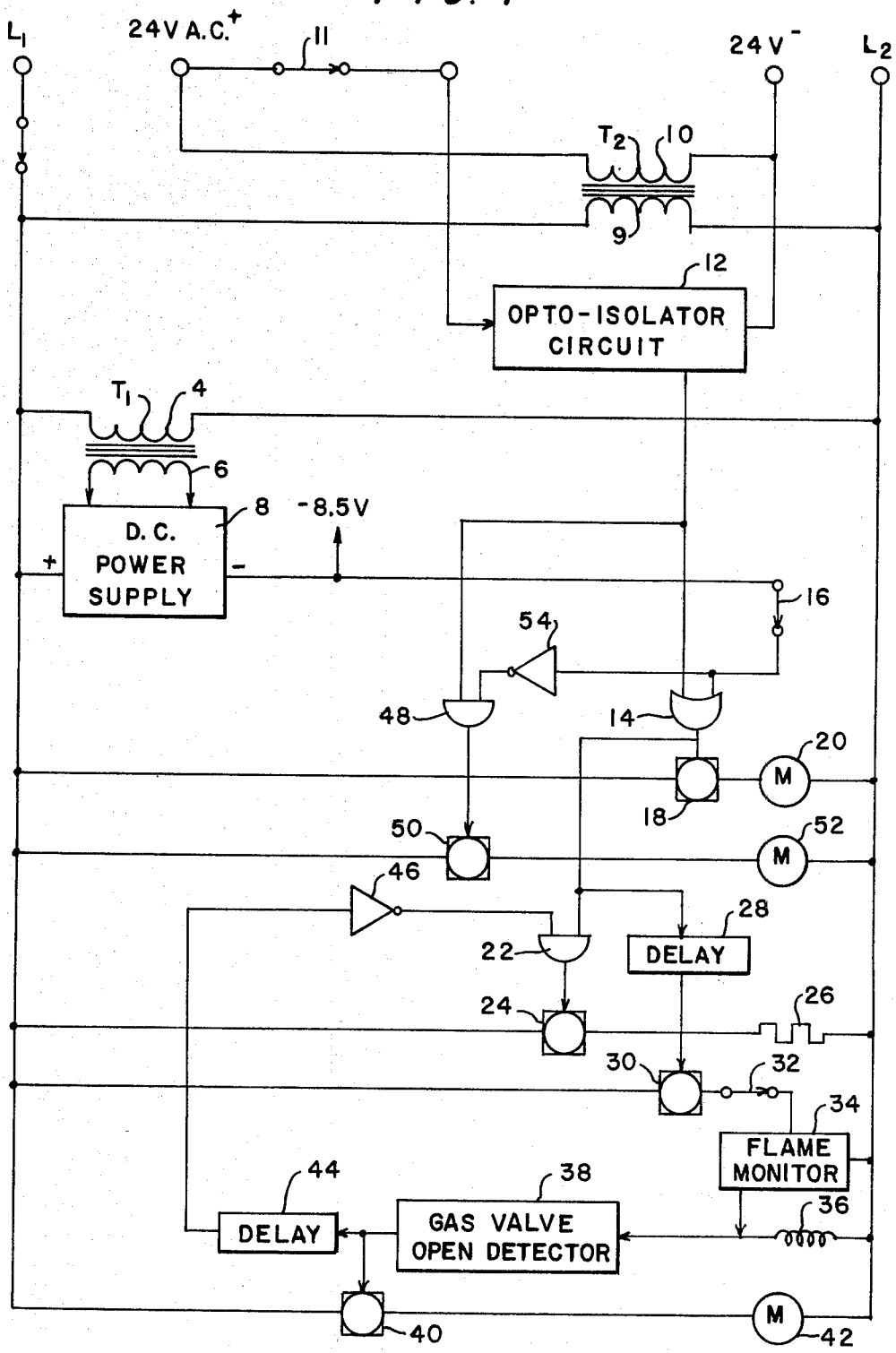
FIG. 1 is a block diagram of the control circuit.

Referring first more particularly to the preferred embodiment of FIG. 1, an electrical control circuit for controlling the operating of a pilotless gas system is connected with supply lines L1, L2 having a given supply voltage (for example, 110 volts AC). Transformer T1, having a primary winding 4 connected across the supply lines, supplies low-voltage power via secondary winding 6 to the regulated DC power supply means 8 (for example, a regulated rectifier circuit, as will be described below).

Step-down transformer T2 is provided having a primary winding 9 connected across the supply lines L1, L2, which transformer includes a low voltage (i.e., 24 volts AC) secondary winding 10 connected in series with room thermostat 11 and opto-isolator circuit 12. The opto-isolator circuit is of conventional design and comprises an infrared light-emitting diode that illuminates a photosensitive transistor. The opto-isolator provides the required isolation between L1 and the low voltage control circuitry that would otherwise be provided by a relay or a transformer. The opto-isolator is advantageous in that it requires virtually no power from the low voltage control transformer T2, it has no moving parts, an indefinite life, and it has an input-to-output breakdown rating of approximately twice that required in the industry.

In accordance with the invention, means for producing an appliance-activating control first signal is provided.

Opto-isolator circuit 12 has an output terminal connected with one of the inputs of an OR logic gate 14. The DC power supply 8 is connected with the other input of the OR gate 14 via a low-limit switch 16. Preferably the control first signal appears at the output of the OR gate when one of the inputs to the OR gate is activated. Thus the appliance is activated either through closing of the thermostat 10 via the opto-isolator circuit 12, or through closing of the low-limit switch 16.

In accordance with the invention, first logic means responsive to the control first signal for activating the igniter, and first delay circuit means responsive to the first signal for producing a second signal delayed from the first signal a first predetermined delay time period are provided. It is preferred that the first signal appearing at the output of OR gate 14 is supplied to three different circuits—namely, to a pump circuit including single-pole, single-throw switch 18 and furnace pump motor 20; to first logic means for activating the igniter, here including AND gate 22, switch 24, and igniter 26 (which here comprises a conventional resistance igniter); and to a first delay circuit 28 which produces a second signal delayed from the first signal by a first predetermined time delay period (for example, 60 seconds).

The second signal appearing at the output of first delay circuit 28 activates a gas supply valve control circuit including switch 30, high-limit switch 32, flame monitor 34, and gas supply valve 36. The gas supply valve 36 opens after the first predetermined delay time period to supply gas to igniter 26, whereby gas is normally ignited by the igniter.

In accordance with the invention, detector means 38 is provided for producing a third signal when the gas supply valve is in the open position. As here embodied the detector means is comprised of detector 38. The detector third signal is supplied to a blower circuit including a switch 40 and the blower 42, in response to opening of the gas supply valve 36. In accordance with the invention, second delay circuit means is provided comprised of circuit 44. The detector third signal also is supplied to second delay circuit 44 which produces a fourth signal delayed from the third signal by a second predetermined delay time period (i.e., 5 seconds) following opening of gas supply valve 36. Second delay circuit 44 is connected with AND gate 22 via inverter 46, whereby the fourth signal deactivates igniter 26 a predetermined time period after opening of the gas supply valve.

The system further includes a circulator control logic circuit including AND gate 48, switch 50, and circulator motor 52. The output terminal of opto-isolator circuit 12 is connected with one input of AND gate 48 and low-limit switch 16 is connected with the other input of AND gate 46 via inverter 54.

The control first signal is produced at the output of OR gate 14 in response to either closing of system thermostat 10, or closing of system low-limit switch 16. The control first signal simultaneously activates pump 20, first delay circuit 28, and igniter 26. Igniter 26 warms up for a first predetermined time period prior to opening of gas supply valve 36, and upon opening of the gas supply valve, the igniter remains activated for a second predetermined time period which allows for combustion of the gas in response to the igniter. After the second predetermined period of time, the igniter is deactivated and ,he appliance continues to operate. If for some reason combustion of the gas does not occur prior to deactivation of the igniter, then after the igniter is deactivated, flame monitor 34 senses that there is no flame in the system and opens the gas supply valve circuit, which automatically closes the gas supply valve to shut off the gas supply. Similarly, if the temperature of the system exceeds a predetermined high limit, high-limit switch 32 opens, and the gas supply valve automatically closes. Thus the control circuit affords improved energy efficiency and safety in a pilotless gas system.

Figure 2:
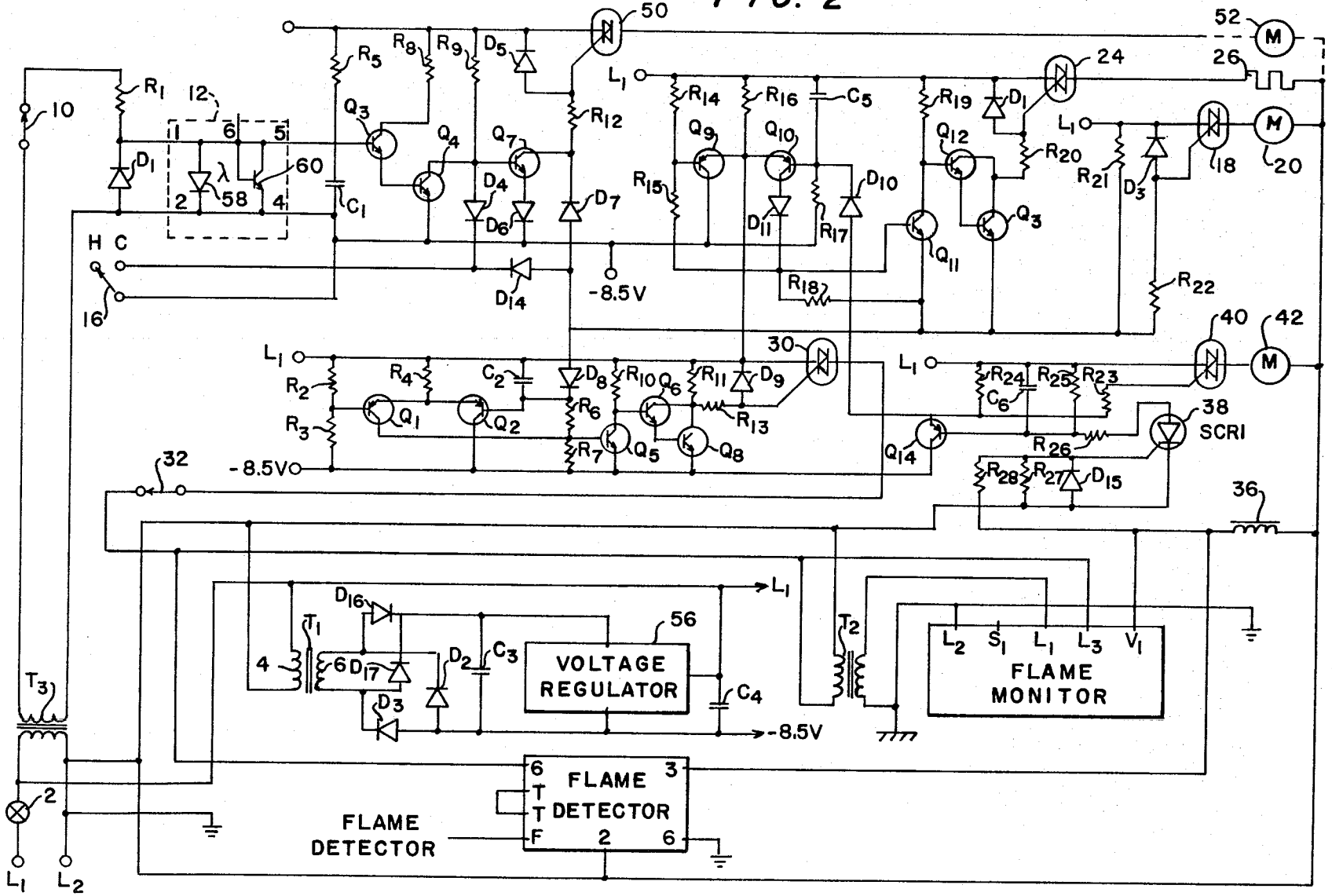
FIG. 2 is a schematic diagram of the control circuit.

The control circuit of FIG. 1 which embodies the present invention is shown in greater detail in the schematic diagram of FIG. 2. The DC power supply for the electrical control circuit includes the transformer T1, diodes D2, D3, D16, and D17 connected in rectifying arrangement in the secondary winding circuit of T1, capacitor C3 connected across secondary coil 6 of T1, and integrated circuit voltage regulator 56 connected in parallel with the capacitor C3. The voltage regulator regulates the logic circuit power supply voltage to precisely 8.5 volts. The voltage regulator is a self-protecting device which will shut off automatically in the event of any component failure or excessive heat, to shut off the appliance. The negative terminal of the power supply is labeled −8.5 volts. This is relative only to the logic circuitry, all of which is referenced to L1. The −8.5 volt line is always negative relative to L1 and is in no way directly referenced to L2 or ground.

As here embodied, opto-isolator circuit 12 connected with thermostat 10 includes infrared light-emitting diode 58 and phototransistor 60. When the thermostat 10 closes, the presence of resistor R1 causes a current to flow through LED 58 during one half-cycle of the applied voltage. The LED actuates photo-transistor 60 to conduct 60 times per second, thereby keeping the capacitor C1 discharged and transistors Q3 and Q4 cutoff, and thus allowing transistor Q7 to conduct. When Q7 conducts, switch 50 is actuated to turn on the circulator 52, and switch 18 is actuated through diode D7 to turn on pump 20. If, however, low-limit switch 16 is closed, then transistor Q7 is prevented from conducting by diode D4. Similarly, with low-limit switch 16 closed, switch 18 will be powered through the diode D14, and the circulator 52 will be prevented from operating by diode D4.

Gas supply valve open detector 38 comprises a semiconductor rectifier SCR-1. Prior to any command for heat, the rectifier SCR-1 detects zero voltage to the gas valve, signaling that the valve is closed. With zero voltage at the valve, transistor Q14 is cutoff and the resistor R24 maintains the transistor Q10 cutoff through the diode D10. When transistor Q10 is cutoff, transistor Q11 is cutoff, allowing transistors Q12 and Q13 to conduct whenever diode D7 or diode D14 conducts, thereby drawing current from switch 24 to activate igniter 26.

The command for heat also reverse biases the diode D8 and allows the capacitor C2 to charge through resistors R6 and R7. After the first predetermined delay time period sufficient for igniter 26 to heat, the transistor Q2 conducts, thereby cutting off transistors Q1 and Q5 and allowing transistors Q6 and Q8 to conduct. Thus, switch 30 is turned on to supply power to the gas supply valve through high-limit switch 32 and flame monitor 34. In a further embodiment, a flame detector 62 is also provided in the gas supply valve control circuit.

When the gas valve open detector semiconductor rectifier SCR-1 detects the voltage at the open gas supply valve 36, transistor Q14 turns on the blower 42 through switch 40 and reverse biases the diode D10. The capacitor C5 then charges through the resistor R17 until the transistor Q10 conducts, which in turn causes transistor Q11 to conduct. As a result, transistors Q12 and Q13 are cutoff to deactivate the igniter 26 after the second predetermined delay time period.

Any interruption of voltage to the gas supply valve while heat is being commanded will cause an immediate repowering of the igniter, and power will not be removed from the igniter until the completion of the second delay time period after the gas supply valve is opened.

The electical control circuit uses no relays and comprises all solid state electronics. The circuit is preferably arranged on a single plug-in circuit board which is removably connected with the gas appliance system. Thus, in the event of circuit failure, the damaged control circuit may be replaced with a substitute control circuit and the damaged circuit may be taken to the shop or factory for repair.

While in accordance with the provisions of the Patent Statutes the preferred forms and embodiments of the invention have been illustrated and described, it will be apparent to those skilled in the art that various changes and modifications may be made without deviating from the inventive concepts set forth above.

What is claimed is:

1. A control circuit for controlling the operation of a pilotless gas system including igniter means and a gas supply valve, comprising:

means for producing an appliance-activating control first signal;

first logic means responsive to said first signal for activating said igniter means;

first delay circuit means for producing a second signal delayed from said first signal by a first predetermined delay time period;

gas supply valve control circuit means responsive to said second delayed signal for opening the gas supply valve after the first predetermined delay time period for exposing said igniter means to said gas;

detector means for producing a third signal when the gas supply valve is in the open position; and second delay circuit means for producing a fourth signal in response to said third signal after a second predetermined delay time period, said fourth signal being applied to said first logic means to deactivate the igniter means said second predetermined time period after opening of the gas supply valve, whereby the igniter means is activated for the first predetermined time period prior to opening of the gas supply valve, and the igniter means is deactivated after the second predetermined time period following opening of the gas supply valve.

2. A control circuit as defined in claim 1, wherein said appliance-activating control first signal producing means includes:

a plurality of voltage sources; and second logic means operable in response to power from at least one of said sources for producing said control first signal.

3. A control circuit as defined in claim 1, wherein said gas supply valve control circuit means includes:

high-limit switch means; and flame monitor means connected with said high-limit switch means for automatically closing the gas supply valve when one of said high-limit switch means and said flame monitor means opens.

4. A control circuit as defined in claim 3, wherein the gas system includes a blower, and said control circuit includes means connected with said detector means for operating the blower in response to said third signal.

5. A control circuit for controlling the operation of a pilotless gas system including an igniter means and a gas supply valve, said control circuit comprising:

means for producing an appliance-activating control first signal, including a plurality of voltage sources and second logic means operable in response to power from at least one of said plurality of voltage sources for producing said control first signal, said second logic means including an OR gate having a pair of inputs and an output, and wherein one of said plurality voltage sources includes a thermostatically controlled opto-isolator circuit means connected with one input of said OR gate, and another of said plurality of voltage sources includes a logic power voltage source, and a low-limit switch connecting said logic power voltage source with the other input of said OR gate, said OR gate providing said control first signal at its output;

first logic means responsive to said control first signal for activating said igniter means;

first delay circuit means for producing a second signal delayed from said control first signal by a first predetermined delay time period;

gas supply valve control circuit means responsive to said second delayed signal for opening said gas supply valve after said first predetermined delay time period for exposing said igniter means to gas;

detector means for producing a third signal when said gas supply valve is in the open position; and second delay circuit means for producing a fourth signal in response to said third signal after said second predetermined delay time period, said fourth signal being applied to said first logic means to deactivate said igniter means said second predetermined time period after said detector means detects the opening of said gas supply valve, whereby said igniter means is activated for said first predetermined time period prior to said gas supply valve opening and said igniter means being deactivated after said second predetermined time period following said gas supply valve opening.

6. A control circuit as defined in claim 5, wherein the gas system also includes a pump, and said control circuit includes means connected with the output of said OR gate for operating the pump in response to said control first signal.

7. A control circuit as defined in claim 6, wherein the gas system also includes a circulator, and said second logic means includes:

a first AND gate for producing a fifth signal, said first AND gate having a pair of inputs and an output, said thermostatically controlled opto-isolator circuit means being connected with one input of said AND gate;

inverter means for connecting said low-limit switch with the other input of said first AND gate; and means connected with the output of said first AND gate for operating the circulator in response to said fifth signal.

8. A control circuit for controlling the operation of a pilotless gas system including an igniter means, a gas supply valve, and a blower, said control circuit comprising:

means for producing an appliance-activating control first signal;

first logic means responsive to said control first signal for activating said igniter means, said first logic means including an AND gate for producing a fifth signal, said AND gate having a pair of inputs and an output, one of said inputs being connected to said control first signal and means connected with the output of said AND gate for activating said igniter means in response to said fifth signal;

first delay circuit means for producing a second signal delayed from said control first signal by a first predetermined delay time period;

gas supply valve control circuit means responsive to said second delayed signal for opening said gas supply valve after said first predetermined delay time period for exposing said igniter means to gas, said gas supply valve circuit means including high-limit switch means and flame monitor means connected with said high-limit switch means for automatically closing said gas supply valve when said high-limit switch means and said flame monitor means open;

detector means for producing a third signal when said gas supply valve is in the open position;

second delay circuit means for producing a fourth signal in response to said third signal after said second predetermined delay time period, said fourth signal being applied to said first logic means to deactivate said igniter means said second predetermined time period after said detector means detects said gas supply valve opening, whereby said igniter means is activated for said first predetermined time period prior to said gas supply valve opening and said igniter means is deactivated after said second predetermined time period following said gas supply valve opening;

inverter means for connecting said second delay circuit means with the other input of said AND gate in said first logic means; and means connected with said detector means for operating said blower in response to said third signal.

* * * * *